US011086253B2

(12) United States Patent
Anufa et al.

(10) Patent No.: US 11,086,253 B2
(45) **Date of Patent: *Aug. 10, 2021**

(54) CARRIER FLUID ADDITION DURING NON-PRINT CYCLES

(71) Applicant: HP INDIGO B.V., Amstelveen (NL)

(72) Inventors: Asaf Anufa, Nes Ziona (IL); Ronen Bitan, Nes Ziona (IL); Doron Schlumm, Nes Ziona (IL); Shmuel Borenstain, Nes Zioina (IL)

(73) Assignee: HP Indigo B.V., Amstelveen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/919,428

(22) Filed: Jul. 2, 2020

(65) Prior Publication Data

US 2020/0333729 A1 Oct. 22, 2020

Related U.S. Application Data

(63) Continuation of application No. 16/348,570, filed as application No. PCT/EP2017/053302 on Feb. 14, 2017, now Pat. No. 10,719,035.

(51) Int. Cl.

| | |
|---|---|
| ***G03G 15/10*** | (2006.01) |
| ***G03G 21/00*** | (2006.01) |
| ***G03G 15/11*** | (2006.01) |

(52) U.S. Cl.

CPC ..... *G03G 15/101* (2013.01); *G03G 15/11* (2013.01); *G03G 21/0094* (2013.01)

(58) Field of Classification Search

CPC ..... G03G 15/1012; G03G 15/11; G03G 21/0088; G03G 21/0094; G03G 15/101

See application file for complete search history.

(56) References Cited

U.S. PATENT DOCUMENTS

| | | | | |
|---|---|---|---|---|
| 5,160,970 | A | 11/1992 | Isogai et al. | |
| 6,442,363 | B2 * | 8/2002 | Chae | G03G 15/11 399/237 |
| 2001/0031156 | A1 | 10/2001 | Chae et al. | |
| 2007/0019996 | A1 | 1/2007 | Romem | |
| 2009/0196657 | A1 | 8/2009 | Okumura et al. | |

FOREIGN PATENT DOCUMENTS

| | | | |
|---|---|---|---|
| DE | 2343935 | A1 | 3/1975 |
| JP | S60129769 | A | 7/1985 |
| JP | 2010185984 | | 8/2010 |
| WO | WO-9626469 | | 8/1996 |
| WO | WO-2016000749 | A1 | 1/2016 |
| WO | WO-2016155755 | | 10/2016 |

* cited by examiner

*Primary Examiner* — Erika J Villaluna
(74) *Attorney, Agent, or Firm* — Michael A Dryja

(57) ABSTRACT

During a print cycle of a print apparatus, a liquid print agent including a carrier fluid is applied to a photoconductive surface. A proportion of the carrier fluid in the liquid print agent on the photoconductive surface is reduced at a first location by removably collecting a portion of the carrier fluid from the liquid print agent applied to the photoconductive surface. During a non-print cycle of the print apparatus, the removably collected portion of the carrier fluid is added to the photoconductive surface at the first location.

17 Claims, 4 Drawing Sheets

CARRIER FLUID ADDITION DURING NON-PRINT CYCLES

BACKGROUND

Print apparatus may apply print agents to a substrate. An example of a print apparatus is a Liquid Electro Photographic (LEP) print apparatus which may be used to print a print agent such as an electrostatic printing fluid or composition (which may be more generally referred to as "an electronic ink" in some examples). Such a printing fluid may comprise electrostatically charged or chargeable particles (for example, resin or toner particles which may be colored particles) dispersed in a carrier fluid.

During some printing operations, a print apparatus may perform a non-print cycle (which may also be termed a 'non-productive print cycle', or a 'null cycle'). Non-print cycles may be performed before, during or after normal printing runs. For example, non-print cycles may be included to maintain the subsystems of the print apparatus in a ready to print state during for example substrate handling operations, while waiting for the temperature of a subsystem to change and/or while waiting for a subsystem to complete an operation. In a further example, non-print cycles may be used to maintain synchronisation between different subsystems.

BRIEF DESCRIPTION OF DRAWINGS

Non-limiting examples will now be described with reference to the accompanying drawings, in which.

DETAILED DESCRIPTION

As noted above, in some examples of print apparatus, a non-print, or 'null', cycle may be used in some operational states.

During a non-print cycle, no image is transferred to a substrate but some of the subsystems continue to operate. For example, rollers may continue to rotate. This can cause wear or damage to components of a print apparatus, in particular if they are operated in a dry condition. This can in turn result in a negative impact on print quality or can lead to components needing to be replaced more frequently. For example, the photoconductive surface may contact an intermediate transfer member and, if there is no liquid print agent or other fluid present on the photoconductive surface, the photoconductive surface or intermediate transfer member may be damaged at the point of contact.

In some examples, therefore, liquid may be transferred to the photoconductive surface during a non-print cycle. This type of non-print cycle is known as a 'wet' non-print cycle, in comparison to a non-print cycle in which no liquid is transferred which is known as a dry non-print cycle. In some examples, the liquid used is a carrier fluid of a liquid print agent.

Figure 1:
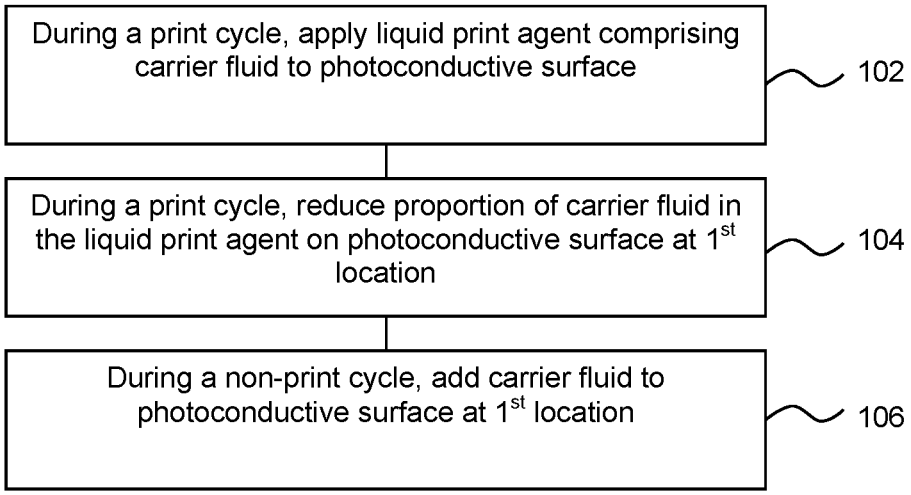
FIG. 1 is a flowchart of an example method of operating a print apparatus.

FIG. 1 is an example of a method, which may be a method of operating a print apparatus. Block 102 comprises applying, during a print cycle of a print apparatus, a liquid print agent comprising a carrier fluid to a photoconductive surface. For example, this may comprise applying liquid print agent from a liquid print agent supply source to form an image on the photoconductive surface. The image may for example comprise text or any other design. In some examples, the photoelectric surface is selectively charged and the applied liquid print agent comprises charged components (e.g. colored particles suspended in a carrier fluid). The charged components experience a force due to the relative charge of the photoconductive surface and the liquid print agent forms an image determined by the selective charging of the photoconductive surface. In some examples, a print cycle may be initiated in response to a user specifying an image to be printed.

Block 104 comprises, during a print cycle, reducing a proportion of the carrier fluid in the liquid print agent on the photoconductive surface at a first location. In some examples, reducing the proportion of carrier fluid in the liquid print agent on the photoconductive surface improves print quality, print speed or throughput of the print apparatus. In some examples the carrier fluid is reduced before transferring the image to a substrate. In some examples, the remaining print agent may be treated to form a film or layer before being applied to the substrate, for example by heating the liquid print agent on an intermediate transfer medium. By reducing the proportion of carrier fluid in the liquid print agent, less thermal energy may be applied to form such a film (or otherwise to dry a print agent), so for example a lower temperature or a shorter heating time may be used. As is described in greater detail below, in some examples, the proportion of carrier fluid in the liquid print agent may be reduced by urging a roller against the surface of the photoconductive surface, and the fluid transferred by capillary action.

Block 106 comprises, during a non-print cycle of the print apparatus, adding carrier fluid to the photoconductive surface at the first location. As noted above, adding carrier fluid to the photoconductive surface may reduce wear of components of the print apparatus compared to performing non-print cycles without adding carrier fluid. In some examples, the carrier fluid may be at least substantially free of, or have a low concentration of, colorant particles.

In some examples, the first location in blocks 104 and 106 is between a second location at which liquid print agent is applied to the photoconductive surface to form a liquid print agent pattern and a third location at which the liquid print agent is transferred from the photoconductive surface. In some examples, a carrier fluid transfer apparatus which is capable of both reducing the proportion of carrier fluid in the liquid print agent on the photoconductive surface during a print cycle and adding carrier fluid to the photoconductive surface during a non-print cycle may be provided at the first location. Thus, the same component may be used in both operations and complexity of the print apparatus is reduced when compared to providing separate components to add and to remove carrier fluid. It may be noted that, in such an example, the component used to add and remove carrier fluid is not the component which applies liquid print agent. If liquid print agent is used during a non-print cycle, the non-print cycle may include cleaning of the PIP to removed colorant particles, which may otherwise negatively impact print quality and/or component life span.

By applying the carrier fluid before liquid print agent is transferred from the photoconductive surface, remaining liquid print agent may be cleaned from the photoconductive surface at a point in the cycle at which a cleaning apparatus may be provided. For example, a cleaning apparatus may be provided such that, in a print cycle, print agent which fails to transfer to an intermediate transfer member or a substrate as intended may remain on the photoconductive surface. To limit any negative impact of such remaining print agent on subsequent print operations, a cleaning apparatus may be supplied to act on the photoconductive surface at such a point in the cycle. Moreover, while it may be the case that carrier fluid could also be added at this point, for example from the cleaning apparatus, this may result in a longer non-print cycle in order to complete an integer number of half-rotations of the photoconductive surface (for example, two half-rotations rather than one).

In some examples a carrier fluid transfer apparatus may recycle carrier fluid removed during a print cycle by applying the same carrier fluid during a non-print cycle, in some examples following filtering or the like.

Although shown in FIG. 1 following on from a print cycle, a non-print cycle may be performed before a print cycle, between print cycles or after a print cycle. Such cycles may be performed in any order. For example multiple print cycles or non-print cycles may be performed sequentially. A non-print cycle could be performed on start-up of a print apparatus, between consecutive print runs or as part of a shut-down sequence of the print apparatus. A non-print cycle could be performed between prints within a print run.

Figure 2A:
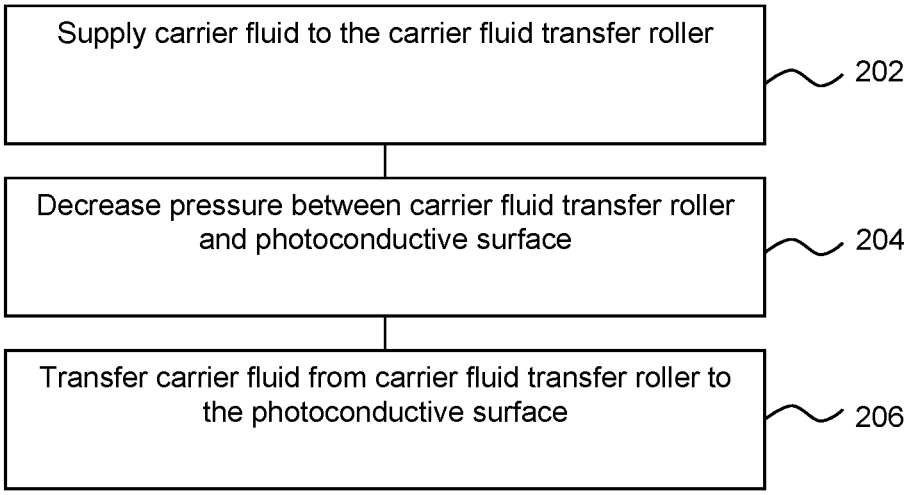
FIG. 2A is a flowchart of an example method of performing a non-print cycle.
Figure 2B:
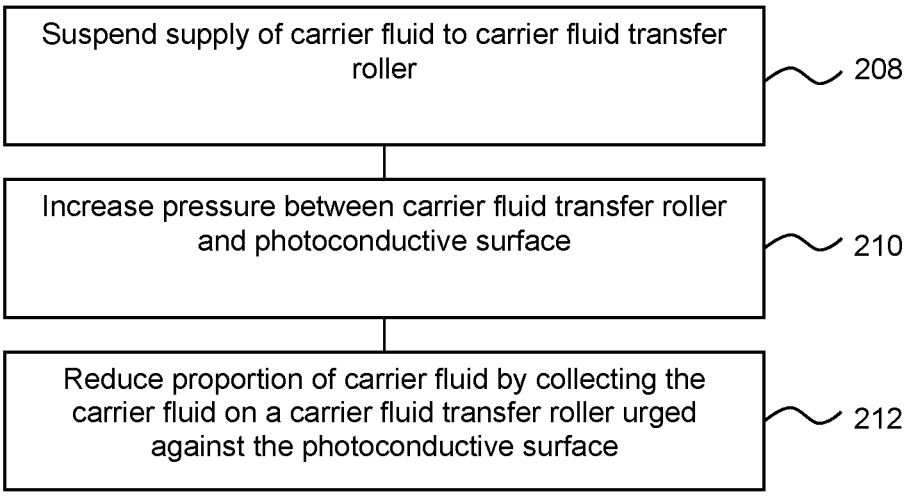
FIG. 2B is a flowchart of an example method of performing a print cycle.

FIG. 2A describes actions taken in an example of a non-print cycle, and FIG. 2B describes actions taken in an example of switching from a non-print cycle to a print cycle, and carrying out a print cycle. In both examples, carrier fluid is transferred from or to the photoconductive surface using a carrier fluid transfer roller which is in contact with the photoconductive surface.

FIG. 2A is an example of a method of carrying out a non-print cycle. Block 202 comprises supplying carrier fluid to the carrier fluid transfer roller. The supply of the carrier fluid to the carrier fluid transfer roller may be carried out selectively, such that the fluid is supplied in a non-print cycle and not in a print cycle. In some examples the carrier fluid is supplied from a roller, for example a sponge roller, which may be supplied with carrier fluid even during a print cycle, then placed into contact with the carrier fluid transfer roller in a non-print cycle. By keeping a supply roller 'wet' but selectively making contact between the supply roller and the carrier fluid transfer roller, a change from a print cycle to a non-print cycle may be effected rapidly, and delays in production rates reduced. Block 204 comprises decreasing a pressure between the carrier fluid transfer roller and the photoconductive surface such that the pressure between the carrier fluid transfer roller and the photoconductive surface in a non-print cycle is lower than the pressure in a print cycle (in other words, a decrease in pressure may follow a print cycle). As is described in relation to FIG. 2B, the pressure is related to the transfer of carrier fluid and may be used to control the transfer: in some examples, a higher pressure may be used to remove at least some carrier fluid from the surface than is used when adding fluid. While the pressure could be the same for both operations (for example being around 50 N/m (Newton per meter) to 500 N/m or around 300 n/m to 500 N/m), reducing the pressure may reduce strain on the components of the print apparatus and/or reduce the pressure between the carrier fluid transfer roller and the photoconductive surface may aid in transfer of carrier fluid from the carrier fluid transfer roller to the photoconductive surface.

Block 206 comprises transferring the carrier fluid from the carrier fluid transfer roller to the photoconductive surface. The carrier fluid may be transferred by capillary action to the photoconductive surface. In some examples, the fluid transfer roller and the photoconductive surface may rotate in different directions to aid fluid transfer.

FIG. 2B is an example of a method of carrying out a print cycle following a non-print cycle, which may for example be carried out as described in FIG. 2A. Block 208 comprises suspending the supply of carrier fluid to the carrier fluid transfer roller. Suspending supply of carrier fluid to the carrier fluid transfer roller promotes transfer of carrier fluid from the photoconductive surface to the carrier fluid transfer roller, which is then relatively dry. Block 210 comprises increasing a pressure between the carrier fluid transfer roller and the photoconductive surface such that the pressure between the carrier fluid transfer roller and the photoconductive surface in a print cycle is higher than the pressure in a non-print cycle. The proportion of carrier fluid which is transferred may depend on the pressure at which the carrier fluid transfer roller is urged against the photoconductive surface. A higher pressure may promote transfer of carrier fluid to the carrier fluid transfer roller. For example, the pressure between the carrier fluid transfer roller and the photoconductive surface may be, in print cycles and in non-print cycles, in the range of between 50 N/m and 500 N/m, or in the range 300 N/m to 500 N/m, with the pressure being higher in a print cycle.

Block 212 comprises reducing the proportion of carrier fluid by collecting the carrier fluid on a carrier fluid transfer roller urged against the photoconductive surface. Effectively, this squeezes the particles away from the carrier fluid transfer roller while some of the carrier fluid transfers to the carrier fluid transfer roller due to capillary forces. For example, around 50% of the carrier fluid initially present in the liquid print agent may be removed in this manner. Viewed another way, reducing the amount of carrier fluid increases the density of solids in the remaining liquid print agent. In some examples, this may increase from around 20% to around 25% to 40%. In some examples, the fluid transfer roller and the photoconductive surface may rotate in different directions to aid smooth fluid transfer.

In some examples, methods may comprise charging the carrier fluid transfer roller to repel charged particles during a print cycle (thereby reducing the proportion of particles within removed carrier fluid) and/or charging the carrier fluid transfer roller so as to attract charged particles during a non-print cycle, so as to promote cleaning of any such particles from the photoconductive surface.

Figure 3:
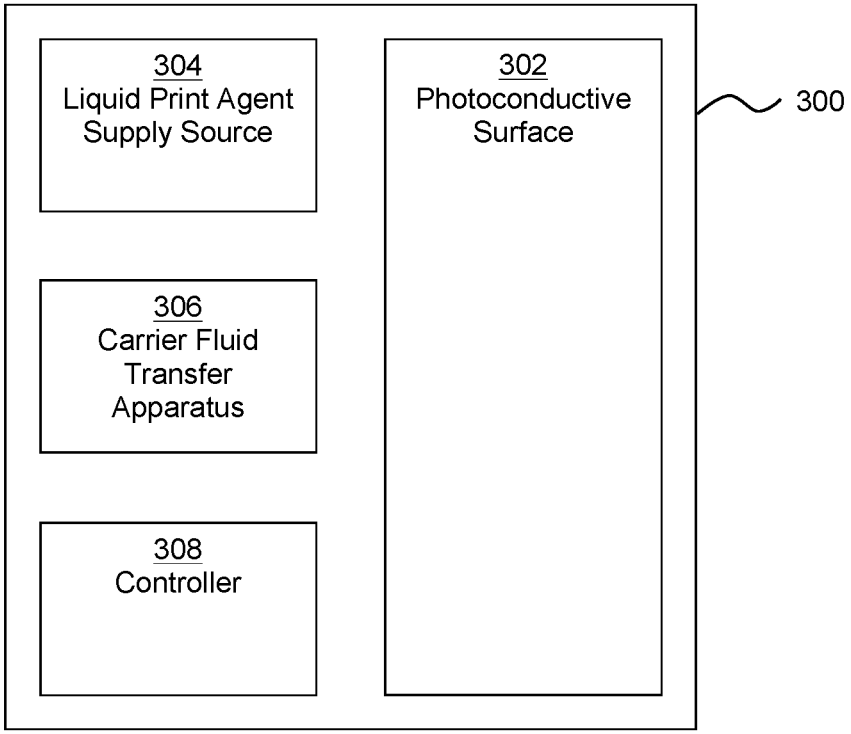
FIG. 3 is a schematic diagram of example print apparatus.

FIG. 3 shows an example of a print apparatus 300 comprising a photoconductive surface 302 (which may for example comprise a photo imaging plate, or PIP, mounted on a drum), a liquid print agent supply source 304 to supply liquid print agent comprising a carrier fluid and charged colorant particles to the photoconductive surface 302 (which may be referred to as a 'binary ink developer', or BID, in some examples). The print apparatus 300 further comprises a carrier fluid transfer apparatus 306 to exchange carrier fluid with photoconductive surface 302 and a controller 308.

The controller 308 is to control the print apparatus 300 such that, in a first mode of operation, the liquid print agent supply source 304 supplies liquid print agent to the photoconductive surface 302 and the carrier fluid transfer apparatus 306 removes carrier fluid from the liquid print agent on the photoconductive surface 302 so as to increase a density of colorant particles in the remaining liquid print agent. The controller 308 is further to control the print apparatus 300 such that, in a second mode of operation, the carrier fluid transfer apparatus 306 supplies carrier fluid to the photoconductive surface 302.

As described in greater detail with reference to FIG. 4 below, the carrier fluid transfer apparatus 306 may comprise a carrier fluid transfer roller which is in contact with the photoconductive surface 302. In such examples, the controller 308 may control, based on the mode of operation (i.e. whether in the first mode or the second mode) at least one of: a supply of carrier liquid to a carrier fluid transfer roller, a pressure between a carrier fluid transfer roller and the photoconductive surface 302, and/or an electric charge on a carrier fluid transfer roller. In doing so the controller 308 may control the transfer of carrier fluid. In some examples increasing the pressure between the carrier fluid transfer roller and photoconductive surface can increase transfer of carrier fluid from the photoconductive surface to the carrier fluid transfer roller. In some examples, the applied pressure may be higher during a print cycle compared with a non-print cycle. In some examples, the controller 308 may control the print apparatus 300 to switch from a print cycle (which includes the first mode of operation) to a non-print cycle (which includes the second mode of operation). Such control may comprise, for example, suspending supply of liquid print agent from the liquid print agent supply source 304 and the like.

Figure 4:
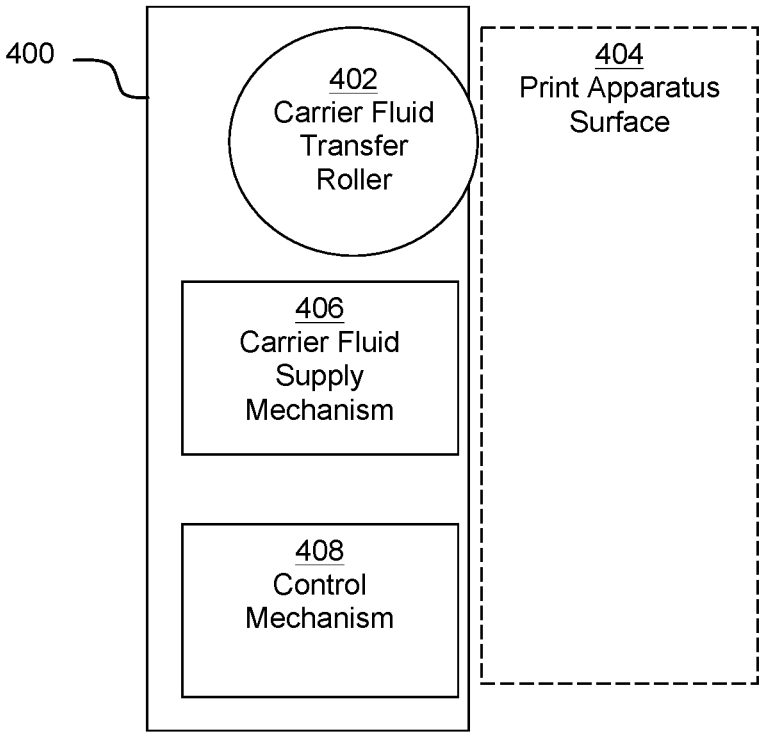
FIGS. 4 and 5 are schematic diagrams of example fluid transfer apparatus.

FIG. 4 shows an example of a carrier fluid transfer apparatus 400, which may be an example of a carrier fluid transfer apparatus 306. The carrier fluid transfer apparatus 400 comprises a carrier fluid transfer roller 402 to exchange liquid print agent carrier fluid with a print apparatus surface 404 (shown in dotted outline as this does not comprise part of the carrier fluid transfer apparatus 400). In some examples, the carrier fluid transfer roller 402 has a hardness of between 18 and 57 Shore A. The carrier fluid transfer apparatus 400 further comprises a carrier fluid supply mechanism 406 to supply carrier fluid to the carrier fluid transfer roller 402. The carrier fluid transfer apparatus 400 also comprises a control mechanism 408 to selectively control the supply of carrier fluid from the carrier fluid supply mechanism 406 to the carrier fluid transfer roller 402. For example the control mechanism 408 may selectively control the supply of carrier fluid from the carrier fluid supply mechanism 406 to the carrier fluid transfer roller 402 such that carrier fluid is supplied from the carrier fluid supply mechanism 406 to the carrier fluid transfer roller 402 when the carrier fluid transfer roller 402 is to supply carrier fluid to the print apparatus surface 404 (e.g. when a print apparatus 300 is operated in the second mode of operation), and not supplied when the carrier fluid transfer roller 402 is to remove carrier fluid from the print apparatus surface 404 (e.g. when a print apparatus 300 is operated in the first mode of operation). In some examples the carrier fluid transfer apparatus 400 is to reduce the proportion of carrier fluid on the photoconductive surface during a print cycle and is to add carrier fluid to the photoconductive surface during a non-print cycle.

Figure 5:
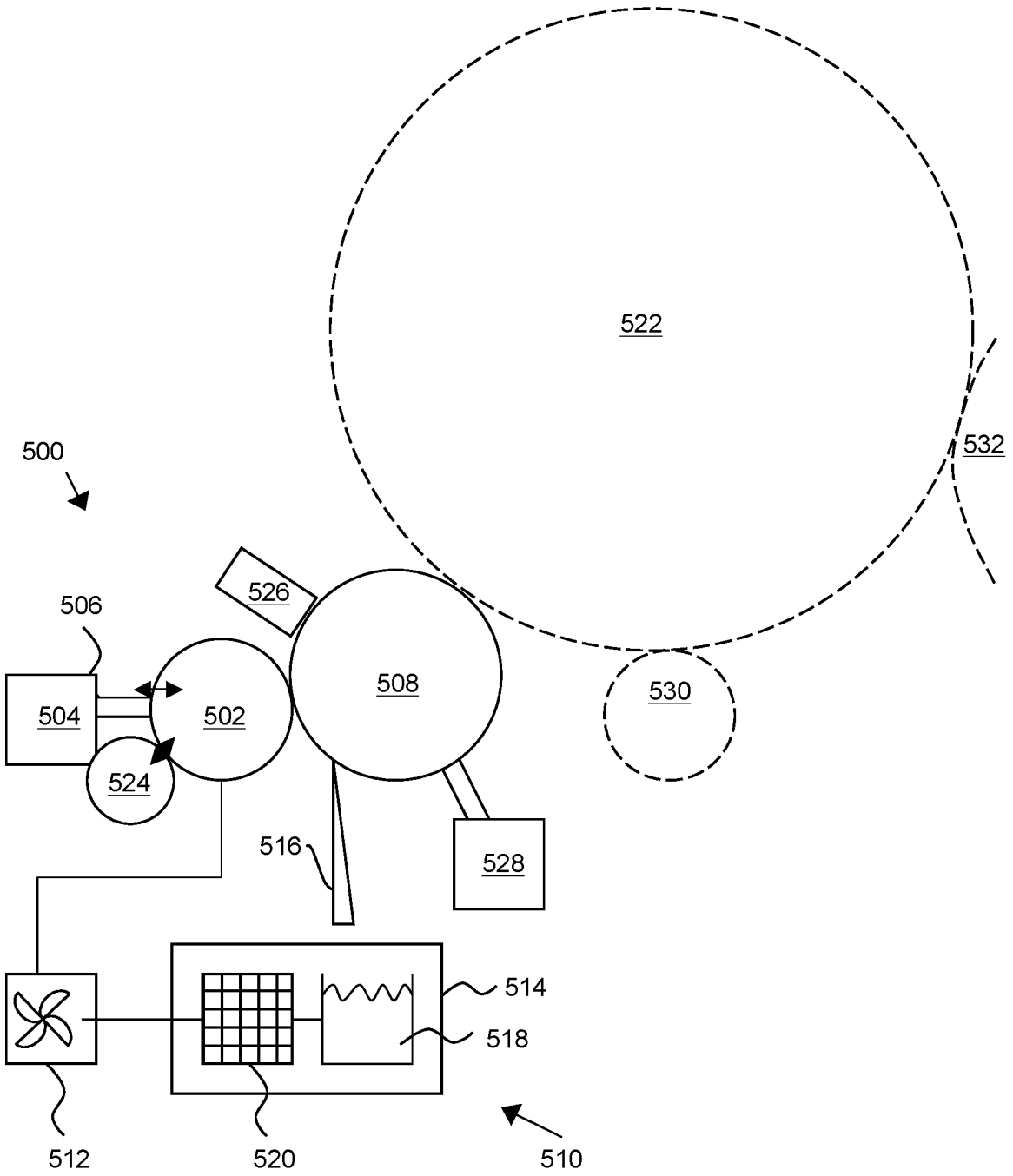

FIG. 5 shows another example of a carrier fluid transfer apparatus 500. The carrier fluid transfer apparatus 500 comprises a carrier fluid supply roller 502 and a control mechanism 504, which in this example comprises positioning apparatus 506 (for example, driven by motors or the like, which may for example be under the control of the controller 308, or some other control mechanism) to control the position of the carrier fluid supply roller 502 relative to a carrier fluid transfer roller 508 so as to selectively cause contact therebetween.

Carrier fluid is supplied to the carrier fluid supply roller 502 by carrier fluid supply mechanism 510. The carrier fluid supply mechanism 510 in this example comprises a pump 512 to effect and/or control an amount of carrier fluid supplied to the carrier fluid transfer roller 508 (therefore, the pump 512 may also comprise part of the carrier fluid control mechanism). In this example the pump 512 transfers recycled carrier fluid collected during a print cycle from a reservoir 518, although in other examples there may be another carrier fluid supply mechanisms, and the carrier fluid may be supplied from another source, for example comprising fresh, or unused, carrier fluid. The pump 512 may continue operate during the print cycle.

By maintaining a 'wet' the carrier fluid supply roller 502 which is selectively engaged with the carrier fluid transfer roller 508, the supply of fluid for non-print cycle may be implemented quickly with a mechanical movement. By keeping the time to switch between a print cycle and a non-print cycle short, productivity rates for a print apparatus may be kept high. However, in other examples, the carrier fluid may be supplied directly from a pump or some other feed system to the carrier fluid transfer roller 508.

The carrier fluid supply mechanism 510 in this example further comprises a carrier fluid recirculation apparatus 514 arranged to collect carrier fluid from the carrier fluid transfer roller 508 and supply carrier fluid to the carrier fluid supply mechanism 510. By collecting and recirculating carrier fluid, running costs may be reduced due to decreased material cost and reduced need for user intervention to replenish carrier fluid supplies.

The carrier fluid recirculation apparatus 514 in this example comprises a blade 516 and the reservoir 518. The blade 516 may be used to remove carrier fluid from the carrier fluid transfer roller 508, in particular during a print cycle when the carrier fluid transfer roller 508 is removing carrier fluid from the photoconductive surface. The collected carrier fluid may be stored in the reservoir 518, which could be any type of container or bottle. Other mechanisms may be used to transfer the carrier fluid to the reservoir 518.

The carrier fluid recirculation apparatus 514 in this example further comprises a filter 520. In some examples the carrier fluid is recycled by processing the collected carrier fluid through the filter 520. The filter 520 may for example remove or reduce a concentration of particles such as colorant and/or clean the carrier fluid. Removing such particles may assist in limiting the transfer of colorants to the photoconductive surface in an uncontrolled manner, which can have a detrimental effect on image quality. Providing a 'clean' supply of carrier fluid (whether that be fresh (unused) or filtered carrier fluid) may assist in maintaining image quality following wet nulls (i.e. wet non-print cycles).

While a particular arrangement is shown in FIG. 5, in other examples the pump 512 may transfer carrier fluid from the reservoir 518 to the filter 520 and then to the carrier fluid supply roller 502, or the carrier fluid may be processed by the filter 520 prior to being stored in the reservoir 518, or the like.

When the control mechanism 504 causes the carrier fluid supply roller 502 to engage with the carrier fluid transfer roller 508, carrier fluid may be transferred from the carrier fluid supply roller 502 to a print apparatus surface 522 (which in this example comprises a photoconductive surface which is shown in dotted line as this does not comprise part of the carrier fluid transfer apparatus 500) via the carrier fluid transfer roller 508. When the control mechanism 504 causes the carrier fluid supply roller 502 to disengage from the carrier fluid transfer roller 508, transfer of carrier fluid is from the carrier fluid supply roller 502 to the carrier fluid transfer roller 508 is prevented.

In this example, the carrier fluid supply roller 502 comprises a sponge roller. This is associated with a carrier fluid control mechanism, which in this example comprises a squeezer roller 524 (although in other examples, this may be a wiper knife, or the like) to control the amount of carrier fluid thereon, in some cases such that the amount may be varied. This may be controlled by controlling the position of the squeezer roller 524 relative to the carrier fluid supply roller 502. Therefore, in this example, a carrier fluid control mechanism comprises the pump 512 and the squeezer roller 524, although in other examples the carrier fluid control mechanism may comprise either, or different, components.

In this example, the carrier fluid transfer apparatus 500 further comprises a pressurising apparatus 526 to urge the carrier fluid transfer roller 508 against the print apparatus surface 522. The pressure applied by the pressurising apparatus 526 may be controllable, for example so as to urge the carrier fluid transfer roller 508 against a print apparatus surface 522 (in this example, the photoconductive surface) with a first pressure when removing carrier fluid from the print apparatus surface 522 and with a second, lower, pressure when supplying carrier fluid to the print apparatus surface 522.

The carrier fluid transfer apparatus 500 further comprises a charging apparatus 528 to charge the carrier fluid transfer roller 508. The charge caused by the charging apparatus 528 may be controllable, and the charging apparatus 528 may be operable to produce a first charge on the carrier fluid transfer roller 508 when removing carrier fluid from the print apparatus surface 522 and to produce a second charge on the carrier fluid transfer roller 508 when supplying carrier fluid to the print apparatus surface 522, wherein the first charge is to repel colorant particles in a liquid print agent and the second charge is to attract colorant particles in the liquid print agent. As noted above, this may assist in separating carrier fluid from the liquid print agent when reducing the proportion of carrier fluid during a print cycle, and in cleaning charged colorant particles from the print apparatus surface during a non-print cycle. In some examples, the first charge may be applied during parts of the print cycle, for example when the roller is in contact with an image region of the photoconductive surface and not when in non-image region. In the non-image region, the second charge may be applied even during a print cycle.

FIG. 5 also shows in dotted outline a location at which a print agent may be applied from a liquid print agent supply source 530 and a location at which the liquid print agent may be transferred from the photoconductive surface, in this example to an intermediate transfer member 532.

The components of the carrier fluid transfer apparatus 500 may for example be controlled by the controller 308 of FIG. 3 when installed in a print apparatus 300, and/or a separate controller.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart.

Examples in the present disclosure can be provided, at least in part, as methods, systems or machine readable instructions, such as any combination of software, hardware, firmware or the like. Such machine readable instructions may be included on a non-transitory machine (for example, computer) readable storage medium (including but is not limited to disc storage, CD-ROM, optical storage, etc.) having computer readable program codes therein or thereon.

The machine readable instructions may, for example, be executed by a general purpose computer, a special purpose computer, an embedded processor or processors of other programmable data processing devices to realize the functions described in the description and diagrams. In particular, a processor or processing apparatus, or a module thereof, may execute the machine readable instructions. Thus functional modules of the print apparatus 300 (for example, the controller 308) and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented, at least in part, in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims, alone or in combination.

We claim:

1. A carrier fluid transfer apparatus comprising:

a carrier fluid transfer roller to exchange liquid print agent carrier fluid with a print apparatus surface;

a carrier fluid supply mechanism to supply carrier fluid to the carrier fluid transfer roller;

a control mechanism to selectively control a supply of carrier fluid from the carrier fluid supply mechanism to the carrier fluid transfer roller such that carrier fluid is supplied from the carrier fluid supply mechanism to the carrier fluid transfer roller when the carrier fluid transfer roller is to supply carrier fluid to the print apparatus surface, and not supplied when the carrier fluid transfer roller is to remove carrier fluid from the print apparatus surface; and a carrier fluid recirculation apparatus to collect the removed carrier fluid from the carrier fluid transfer roller and to supply the collected carrier fluid to the carrier fluid supply mechanism, wherein the carrier fluid supply mechanism comprises a carrier fluid supply roller and the control mechanism comprises a positioning apparatus to control the position of the carrier fluid supply roller relative to the carrier fluid transfer roller so as to selectively cause contact therebetween to supply carrier fluid from the carrier fluid supply mechanism to the carrier fluid transfer roller, and to selectively prevent contact to prevent supply of carrier fluid from the carrier fluid supply mechanism to the carrier fluid transfer roller.

2. A carrier fluid transfer apparatus according to claim 1 wherein the carrier fluid supply mechanism comprises a carrier fluid control mechanism to control an amount of carrier fluid on the carrier fluid transfer roller.

3. A carrier fluid transfer apparatus according to claim 1 wherein the carrier fluid recirculation apparatus comprises a blade and a reservoir.

4. A carrier fluid transfer apparatus according to claim 1 wherein the carrier fluid recirculation apparatus comprises a filter.

5. A carrier fluid transfer apparatus according to claim 1 further comprising a charging apparatus to charge the carrier fluid transfer roller, wherein charging apparatus is to produce a first charge on the carrier fluid transfer roller when removing carrier fluid from the print apparatus surface and to produce a second charge on the carrier fluid transfer roller when supplying carrier fluid to the print apparatus surface, wherein the first charge is to repel colorant particles in a liquid print agent and the second charge is to attract colorant particles in the liquid print agent.

6. A carrier fluid transfer apparatus according to claim 1 further comprising a pressurizing apparatus to urge the carrier fluid transfer roller against a print apparatus surface, wherein the pressurizing apparatus is to urge the carrier fluid transfer roller against the print apparatus surface with a first pressure when removing carrier fluid from the print apparatus surface and with a second, lower, pressure when supplying carrier fluid to the print apparatus surface.

7. A print apparatus comprising:

a print apparatus surface; and a carrier fluid transfer apparatus comprising:

a carrier fluid transfer roller to exchange liquid print agent carrier fluid with the print apparatus surface;

a carrier fluid supply mechanism to supply carrier fluid to the carrier fluid transfer roller;

a control mechanism to selectively control a supply of carrier fluid from the carrier fluid supply mechanism to the carrier fluid transfer roller such that carrier fluid is supplied from the carrier fluid supply mechanism to the carrier fluid transfer roller when the carrier fluid transfer roller is to supply carrier fluid to the print apparatus surface, and not supplied when the carrier fluid transfer roller is to remove carrier fluid from the print apparatus surface;

a carrier fluid recirculation apparatus to collect the removed carrier fluid from the carrier fluid transfer roller and to supply the collected carrier fluid to the carrier fluid supply mechanism; and a charging apparatus to charge the carrier fluid transfer roller, wherein the charging apparatus is to produce a first charge on the carrier fluid transfer roller when removing carrier fluid from the print apparatus surface and to produce a second charge on the carrier fluid transfer roller when supplying carrier fluid to the print apparatus surface, wherein the first charge is to repel colorant particles in a liquid print agent and the second charge is to attract colorant particles in the liquid print agent.

8. A print apparatus according to claim 7 wherein the carrier fluid supply mechanism comprises a carrier fluid supply roller and the control mechanism comprises a positioning apparatus to control the position of the carrier fluid supply roller relative to the carrier fluid transfer roller so as to selectively cause contact therebetween to supply carrier fluid from the carrier fluid supply mechanism to the carrier fluid transfer roller, and to selectively prevent contact to prevent supply of carrier fluid from the carrier fluid supply mechanism to the carrier fluid transfer roller.

9. A print apparatus according to claim 7 wherein the carrier fluid supply mechanism comprises a carrier fluid control mechanism to control an amount of carrier fluid on the carrier fluid transfer roller.

10. A print apparatus according to claim 7 wherein the carrier fluid recirculation apparatus comprises a blade and a reservoir.

11. A print apparatus according to claim 7 wherein the carrier fluid recirculation apparatus comprises a filter.

12. A print apparatus according to claim 7 wherein the carrier fluid transfer apparatus further comprises a pressurizing apparatus to urge the carrier fluid transfer roller against a print apparatus surface, wherein the pressurizing apparatus is to urge the carrier fluid transfer roller against the print apparatus surface with a first pressure when removing carrier fluid from the print apparatus surface and with a second, lower, pressure when supplying carrier fluid to the print apparatus surface.

13. A print apparatus comprising:

a print apparatus surface; and a carrier fluid transfer apparatus comprising:

a carrier fluid transfer roller to exchange liquid print agent carrier fluid with the print apparatus surface;

a carrier fluid supply mechanism to supply carrier fluid to the carrier fluid transfer roller;

a control mechanism to selectively control a supply of carrier fluid from the carrier fluid supply mechanism to the carrier fluid transfer roller such that carrier fluid is supplied from the carrier fluid supply mechanism to the carrier fluid transfer roller when the carrier fluid transfer roller is to supply carrier fluid to the print apparatus surface, and not supplied when the carrier fluid transfer roller is to remove carrier fluid from the print apparatus surface;

a carrier fluid recirculation apparatus to collect the removed carrier fluid from the carrier fluid transfer roller and to supply the collected carrier fluid to the carrier fluid supply mechanism; and a pressurizing apparatus to urge the carrier fluid transfer roller against a print apparatus surface, wherein the pressurizing apparatus is to urge the carrier fluid transfer roller against the print apparatus surface with a first pressure when removing carrier fluid from the print apparatus surface and with a second, lower, pressure when supplying carrier fluid to the print apparatus surface.

14. A print apparatus according to claim 13 wherein the carrier fluid supply mechanism comprises a carrier fluid supply roller and the control mechanism comprises a positioning apparatus to control the position of the carrier fluid supply roller relative to the carrier fluid transfer roller so as to selectively cause contact therebetween to supply carrier fluid from the carrier fluid supply mechanism to the carrier fluid transfer roller, and to selectively prevent contact to prevent supply of carrier fluid from the carrier fluid supply mechanism to the carrier fluid transfer roller.

15. A print apparatus according to claim 13 wherein the carrier fluid supply mechanism comprises a carrier fluid control mechanism to control an amount of carrier fluid on the carrier fluid transfer roller.

16. A print apparatus according to claim 13 wherein the carrier fluid recirculation apparatus comprises a blade and a reservoir.

17. A print apparatus according to claim 13 wherein the carrier fluid recirculation apparatus comprises a filter.

* * * * *